US006824700B2

(12) United States Patent
Iyengar et al.

(10) Patent No.: US 6,824,700 B2
(45) Date of Patent: Nov. 30, 2004

(54) GLYCOL-BASED MR FLUIDS WITH THICKENING AGENT

(75) Inventors: Vardarajan R. Iyengar, Macomb, MI (US); Thad J. Kacsandy, Kettering, OH (US)

(73) Assignee: Delphi Technologies, Inc., Troy, MI (US)

( * ) Notice: Subject to any disclaimer, the term of this patent is extended or adjusted under 35 U.S.C. 154(b) by 18 days.

(21) Appl. No.: 10/342,940

(22) Filed: Jan. 15, 2003

(65) Prior Publication Data

US 2004/0135114 A1 Jul. 15, 2004

(51) Int. Cl.[7] ..... H01J 1/44
(52) U.S. Cl. ..... 252/62.52
(58) Field of Search ..... 252/62.52

(56) References Cited

U.S. PATENT DOCUMENTS

| | | | | |
|---|---|---|---|---|
| 4,957,644 A | | 9/1990 | Price et al. | 252/62.52 |
| 4,992,190 A | | 2/1991 | Shtarkman | 252/62.52 |
| 5,354,488 A | | 10/1994 | Shtarkman et al. | 252/62.56 |
| 5,382,373 A | | 1/1995 | Carlson et al. | 252/62.55 |
| 5,578,238 A | | 11/1996 | Weiss et al. | 252/62.52 |
| 5,599,474 A | | 2/1997 | Weiss et al. | 252/62.52 |
| 5,645,752 A | | 7/1997 | Weiss et al. | 252/62.54 |
| 5,667,715 A | | 9/1997 | Foister | 252/62.52 |
| 5,670,077 A | | 9/1997 | Carlson et al. | 252/62.52 |
| 5,906,767 A | * | 5/1999 | Karol et al. | 252/62.52 |
| 5,985,168 A | | 11/1999 | Phule | 252/62.52 |
| 5,989,447 A | | 11/1999 | Podszun et al. | 252/62.52 |
| 6,027,664 A | | 2/2000 | Weiss et al. | 252/62.52 |
| 6,036,765 A | | 3/2000 | Farrow et al. | 106/487 |
| 6,132,633 A | | 10/2000 | Carlson | 252/62.52 |
| 6,203,717 B1 | | 3/2001 | Munoz et al. | 252/62.52 |
| 6,451,219 B1 | | 9/2002 | Iyengar et al. | |
| 6,547,983 B2 | | 4/2003 | Iyengar | |
| 6,592,772 B2 | | 7/2003 | Foister et al. | |
| 6,599,439 B2 | | 7/2003 | Iyengar et al. | |
| 6,638,443 B2 | | 10/2003 | Iyengar et al. | |

FOREIGN PATENT DOCUMENTS

| | | |
|---|---|---|
| JP | 61185903 | 8/1986 |
| WO | WO 94/10692 | 5/1994 |
| WO | WO 94/10693 | 5/1994 |

* cited by examiner

*Primary Examiner*—C. Melissa Koslow
(74) *Attorney, Agent, or Firm*—Michael D. Smith

(57) ABSTRACT

A magnetorheological fluid formulation comprising magnetizable particles dispersed in a non-aqueous, glycol-based liquid vehicle thickened effectively by either a fully treated fumed silica or an organoclay. The surface treated fumed silica is fully treated with a treatment molecule having a molecular weight of at least about 200. The organoclay comprises sepiolite and/or palygorskite. The glycol-based fluid advantageously consists essentially of propylene glycol and optionally ethylene glycol.

26 Claims, No Drawings

GLYCOL-BASED MR FLUIDS WITH THICKENING AGENT

TECHNICAL FIELD

This invention relates to magnetorheological fluids, and more particularly, to thickening of non-aqueous, glycol-based magnetorheological fluid formulations.

BACKGROUND OF THE INVENTION

Magnetorheological (MR) fluids are substances that exhibit an ability to change their flow characteristics by several orders of magnitude and in times on the order of milliseconds under the influence of an applied magnetic field. These induced rheological changes are completely reversible. The utility of these materials is that suitably configured electromechanical actuators that use magnetorheological fluids can act as a rapidly responding active interface between computer-based sensing or controls and a desired mechanical output. With respect to automotive applications, such materials are seen as a useful working media in shock absorbers, brakes for controllable suspension systems, vibration dampers in controllable power train and engine mounts and in numerous electronically controlled force/torque transfer (clutch) devices.

MR fluids are noncolloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about one Tesla. The MR fluid must be compatible with materials encountered in operation. When used in controllable power train mounts, for example, the MR fluid is in contact with natural or synthetic rubber. Typically, mounts are primarily made of natural rubber, and so the MR fluid must be compatible with, i.e. not soluble in, natural rubber. Mineral oils, synthetic hydrocarbons and esters often used in MR fluids have a tendency to swell natural rubber, thereby degrading its physical properties, which is undesirable. Silicone oils do not swell natural rubber, but are not acceptable in manufacturing environments that include adhesion and painting processes. Therefore, conventional base oils can cause difficulties when used to formulate MR fluids for controlled mounts. The only known MR fluid that is compatible with natural rubber mounts is the fluid disclosed in U.S. Pat. No. 5,670,077, which discloses aqueous MR fluids in which the base liquid is primarily water. In addition to water, the MR fluid further contains a glycol compound. Passive hydramounts often use ethylene glycol and water as the mount fluid because the fluid is compatible with natural rubber and the ethylene glycol provides a wider operating temperature range compared to only water.

Despite their compatibility with natural rubber, ethylene glycol and water cannot be used as the base liquid for an MR fluid because the presence of water causes the iron particles to rust, thereby affecting the magnetic performance over time. In addition, the presence of water, even in small amounts, detrimentally affects the performance of the mount at high temperatures. Thus, it is desirable to provide an MR fluid in which the liquid vehicle is substantially free of water.

Because MR fluids contain noncolloidal solid particles which are at least five times more dense than the liquid phase in which they are suspended, suitable dispersions of the particles in the liquid phase must be prepared so that the particles do not settle appreciably upon standing nor do they irreversibly coagulate to form aggregates. Without some means of stabilizing or suspending the solid, sedimentation and/or flow induced separation of the solid phase from the liquid phase will occur. Such separation will have a drastic and detrimental effect on the ability of the MR fluid to provide optimal and repeatable performance. Thus, the magnetizable particles are kept in suspension by dispersing a thixotropic agent or thickener in the liquid vehicle.

While glycols, such as ethylene glycol, may be used by themselves as the base fluid for mount MR fluids, due to their strong polar nature, most thickeners that have been used successfully for non-polar mineral and synthetic oils do not work in a glycol-based base fluid such as ethylene glycol. Many thickeners are recommended for aqueous systems containing small amounts of glycols, but for glycol systems substantially free of water, there are few thickeners that have been recommended. One thickener that has been recommended for use with glycols is polyvinylpyrrolidone (PVP). However, PVP-thickened fluids settle and have an unacceptably high viscosity. There is thus a need for a non-aqueous MR fluid formulation that is compatible in MR devices containing natural rubber, which fluid may be effectively thickened, and which does not experience settling of the magnetizable particles and unacceptably high viscosity during use.

SUMMARY OF THE INVENTION

The present invention provides a magnetorheological fluid formulation comprising magnetizable particles dispersed in a non-aqueous liquid vehicle comprising a glycol-based fluid thickened effectively by either a fully treated fumed silica or an organoclay such that less than about 20% particle settling occurs in use. The surface treated fumed silica is fully treated with a treatment agent having a molecular weight of at least about 200, and advantageously, at least about 600, such a polydimethylsiloxane. The organoclay comprises sepiolite and/or palygorskite, and advantageously comprises a clay mixture of about 50–95% sepiolite, palygorskite, or a mixture of sepiolite and palygorskite, the balance smectite, with a surface treatment including reaction with a quaternary ammonium compound. In an exemplary embodiment of the present invention, the glycol-based fluid consists essentially of propylene glycol and optionally ethylene glycol.

DETAILED DESCRIPTION

The present invention provides an MR fluid formulation comprising magnetizable particles dispersed in a non-aqueous liquid vehicle comprising a glycol-based fluid, wherein the fluid is thickened with a fully treated fumed silica or an organoclay mixture comprising sepiolite and/or palygorskite. It has been unexpectedly found that non-aqueous glycol-based fluids can be thickened effectively with these particular surface treated clays (organoclays) and fully treated fumed silicas, particularly where the glycol-based fluid consists essentially of propylene glycol alone or in addition to ethylene glycol. It has been unexpectedly found that as the percentage of propylene glycol increases in the glycol-based fluid, the fluid viscosity similarly increases and the amount of particle settling decreases. The result is unexpected because ethylene glycol and propylene glycol are chemically similar and both have a strongly polar nature.

In an exemplary embodiment of the present invention, the glycol-based fluid consists essentially of propylene glycol and ethylene glycol. Thus, the fluid is substantially free of oil and water. Due to the greater thickening effect observed for propylene glycol, the glycol-based fluid advantageously includes an ethylene glycol to propylene glycol ratio of about 70:30 to about 0:100. In another example of the present invention, the glycol-based fluid comprises at least about 50 wt. % propylene glycol, the balance ethylene glycol. In another example of the present invention, the glycol-based fluid comprises 100 wt. % propylene glycol.

The MR fluid formulation of the present invention is substantially free of water, which can cause corrosion of the magnetizable particles. More specifically, the composition advantageously contains less than about 3% water, and more advantageously, less than about 0.5% water. It is to be understood that both propylene glycol and ethylene glycol are hygroscopic, and thus may absorb water from the surroundings during preparation and use of the fluid. Due to the non-aqueous nature of the fluid formulation of the present invention, a thickening agent is required which is effective for glycol systems that are substantially free of water. Suitable thickening agents include certain hydrophobic organoclays and certain surface treated fumed silica, as described below. Most automotive applications cannot tolerate settling of the magnetizable particles greater than about 20%, and in some applications, less than about 10% settling is preferred or required. Thus, the thickening agent, to be considered effective in the MR fluid formulation of the present invention, should achieve less than about 20% particle settling, and preferably less than about 10%.

One exemplary thickener for use in the fluid formulation of the present invention is a hydrophobic organoclay that provides soft sedimentation, such as that commercially available under the tradename GARAMITE® from Southern Clay Products, Gonzales, Tex. For example, GARAMITE® 1958 effectively thickens glycol-based fluids, particularly those containing propylene glycol. The GARAMITE® organoclays are a clay mixture comprising sepiolite and/or palygorskite, and thus have a clay chemistry distinguishable from other types of organoclays. More specifically, many organoclays used for thickening fluids, in particular oil-based fluids, are surface treated montmorillonite clays. Montmorillonite is a type of smectite, wherein smectite refers to the general class of clay minerals with expanding crystal lattices, with the exception of vermiculite. This includes the dioctahedral smectites, which consist of montmorillonite, beidellite, and nontronite, and to the trioctahedral smectites, which includes saponite, hectorite, and sauconite. The difference between various grades is generally due to the specific types of molecules used in surface treatment, as well as the level of treatment. The surface treatment generally includes reaction with a quaternary ammonium compound. However, the type and level of surface treatment of montmorillonite clays does not seem to significantly affect the thickening ability of the clay in propylene glycol. Yet, unexpectedly, clay mixtures comprising sepiolite and/or palygorskite exhibit significantly lower settling than other hydrophobic organoclays.

An exemplary mineral clay mixture comprises 50–95 wt. % sepiolite, palygorskite, or a mixture of the two, with the balance of the clay mixture being smectite, as set forth in U.S. Pat. No. 6,036,765, the disclosure of which is incorporated by reference herein in its entirety. GARAMITE® 1958 is one such clay. The unexpectedly low settling is believed to be attributed to the interaction between the sepiolite and/or palygorskite mixture and propylene glycol. Glycol-based MR fluids advantageously comprise between about 5% and about 15%, and more advantageously between about 7% and about 10% weight fraction of the organoclay to effectively thicken and limit the settling of magnetorheological fluids. Besides the GARAMITE® organoclays, other appropriate organoclays would include those having a mineral clay mixture comprising sepiolite and/or palygorskite, and advantageously, mixtures comprising about 50–95% sepiolite, palygorskite, or a mixture of sepiolite and palygorskite, the balance smectite, and a surface treatment including reaction with a quaternary ammonium compound, such as an alkyl quaternary ammonium salt.

In another example of the present invention, the thickener is fully treated fumed silica, and is advantageously present in the MR fluid in an amount between about 3% and about 10%, and more advantageously between about 3% and about 6% weight fraction to effectively thicken and limit the settling of the magnetizable particles. Unexpectedly, the fully treated fumed silicas having large treatment molecules are more efficient at thickening the ethylene glycol/propylene glycol mixtures than untreated fumed silicas, partially-treated fumed silicas, and the fully treated fumed silicas having small treatment molecules. Thus, for glycol-based fluids, the type of surface treatment and the level of coverage of the surface treatment influence the thickening efficiency of the fumed silica. Also unexpectedly, the size of the silica particles do not appear to have any significant effect on the treated fumed silica's ability to thicken the glycol-based fluid.

Untreated hydrophilic fumed silica thickens fluids by hydrogen bonding via surface hydroxyl groups. A partial surface treatment reacts a portion of the surface hydroxyl groups to render the silica hydrophobic, and the unreacted hydroxyl groups remain available to participate in hydrogen bonding. A fully treated fumed silica does not effectively thicken by hydrogen bonding because the hydrogen bonding sites are removed by complete reaction with the treatment molecules. The fully treated fumed silicas rely on interaction of the modified surface chemistry with the liquid vehicle for the thickening mechanism. A fumed silica is considered to be fully treated when the surface no longer reacts with the treatment molecules. The carbon content of the fumed silica is indicative of the level of treatment, with carbon levels below about 3% suggesting only partial treatment, and levels above about 3% suggesting full treatment, though the carbon content will vary depending on the type of surface treatment. For example, the larger treatment molecule will result in a higher carbon content in a fully treated fumed silica than a smaller treatment molecule.

A number of commercially available fumed silicas are available from Cabot Corporation under the tradename CABOSIL®, for example CABOSIL® EH5, CABOSIL® M5, CABOSIL® TS720, CABOSIL® TS530 and CABOSIL® TS610, and a number are available from Degussa AG under the tradename AEROSIL®, for example, AEROSIL® 200, AEROSIL® 380, AEROSIL® R972, AEROSIL® R974 and AEROSIL® R202. These various grades, however, differ in the type and level of surface treatment. CABOSIL® EH5, CABOSIL® M5, AEROSIL® 200 and AEROSIL® 380 are untreated, i.e., hydrophilic. CABOSIL® TS610 and AEROSIL® R974 and R972 are examples of partially treated fumed silicas, which is indicated by carbon contents of less than 2%. CABOSIL® TS530, CABOSIL® TS720 and AEROSIL R202 are examples of fully treated fumed silicas, as indicated by carbon contents greater than 3%. For non-aqueous, glycol-based fluids, it has been found, unexpectedly, that where the surface treatment completely covers the fumed silica, the thickening efficiency is greater compared to an organic treatment that only partially treats the surface of the fumed silica particles. Thus, glycol-based liquids would appear to thicken more effectively by interaction with the surface chemistry of the fumed silica.

Even more unexpectedly, it has been found that fumed silicas fully treated with relatively large molecules are more effective at thickening then fumed silicas fully treated with relatively small molecules. A fumed silica fully treated with a dimethylsiloxane fluid, such as CABOSIL® TS720 or AEROSIL® R202, for which the treatment molecule has a molecular weight (weight average) of about 681 to 11,189 (8–150 units of the dimethylsiloxane monomer) provides more effective thickening via interaction of the modified surface chemistry than a fumed silica fully treated with hexamethyldisilazane, for example, for which the treatment molecule has a molecular weight (weight average) of only 89. In the present invention, the interaction between the polydimethylsiloxane surface chemistry and propylene glycol provide an unexpected thickening and anti-settling ability. Thus, to effectively thicken a glycol-based fluid, the surface of the fumed silica should be fully treated, and the treatment molecule should be large, such as those having a molecular weight (weight average) equal to or greater than that of polydimethylsiloxane, e.g., at least about 200, and advantageously, at least about 600. Advantageously, the fumed silica is surface treated completely with polydimethylsiloxane. CABOSIL® TS720 and AEROSIL® R202 are examples of fumed silica with full surface treatment with polydimethylsiloxane The MR fluid formulation also comprises magnetizable particles dispersed in the liquid vehicle to form the suspension. Any solid that is known to exhibit magnetorheological activity may be used in the MR formulations of the present invention. For example, the magnetizable particles may comprise iron, nickel, cobalt, and their magnetic alloys, as is now known or hereafter developed in the art. In an exemplary embodiment, the magnetizable particles comprise 5–60 vol. % of the MR formulation.

In one embodiment of the present invention, the MR fluid formulation may also comprise one or more additives, such as corrosion inhibitors, defoamers, defoamers, preservatives, dyes and/or pigments.

The fluid formulations of the present invention may be made by any of a variety of conventional mixing method. Advantageously, the thickener is mixed with the non-aqueous liquid vehicle first, followed by addition of the magnetizable particles. The resulting formulation, in use, will exhibit less than about 20% settling, and even less than 10% settling, of the magnetizable particles.

EXAMPLES

Example 1

The following ethylene glycol/propylene glycol ratios were combined with 10% weight fraction GARAMITE® 1958 organoclay: 100:0, 70:30, 50:50, 35:65 and 0:100. The thickened glycol fluids were observed and it was generally found that as the percentage of propylene glycol increased, the fluid viscosity similarly increased and the amount of clear fluid layer at the top of the fluid decreased.

An MR fluid formulation of the present invention may comprise the following: x grams ethylene glycol/propylene glycol; y grams BASF carbonyl iron powder CM; and z grams GARAMITE® 1958 organoclay. The organoclay may be added to the glycol while stirring in a mixer, such as a Ross 100LC mixer, at around 1500 rpm. The speed is increased to 2000 rpm and the suspension is mixed for about three minutes. The clay is then dispersed using a CAT X520 high-speed disperser at 15000 rpm for three minutes. The iron particles are then added while mixing in the Ross 100LC at 2500 rpm. Finally, the fluid is high-shear mixed at 15000 rpm for two minutes to achieve proper thickening. It was found that the makeup of the glycol-based fluid has only a minor influence upon the settling properties of the MR fluid as compared to the choice and amount of thickening agent used. Glycol-based MR fluids were found to generally require between about 7% and 10% weight fraction of GARAMITE® 1958 to effectively thicken and limit the settling of carbonyl iron powder.

Example 2

A CABOSIL® TS720 fumed silica thickener was added to the five following glycol fluids at 5% weight fraction, with the fluids varying in appearance and consistency: (1) 100% ethylene glycol with 5% weight fraction fumed silica resulted in a dense foam having small pores and a considerable liquid layer at the bottom, the consistency being comparable to shaving cream; (2) 70% ethylene glycol and 30% propylene glycol with 5% weight fraction fumed silica exhibited a dense foam with larger pores and small liquid layer, with a consistency comparable to shaving cream; (3) 50% ethylene glycol and 50% propylene glycol with 5% weight fraction fumed silica produced a dense foam with small pores and no liquid layer, with a consistency comparable to whipped cream; (4) 35% ethylene glycol and 65% propylene glycol with 5% weight fraction fumed silica exhibited a creamy foam without pores and no liquid layer, with a consistency comparable to thin yogurt; and (5) 100% propylene glycol with 5% weight fraction fumed silica exhibited a clear gel, with no foam and no liquid layer, and a consistency comparable to hair gel.

An MR fluid formulation was made in accordance with the following: x grams ethylene glycol/propylene glycol; y grams BASF carbonyl iron powder CM; and z grams Cabot fumed silica TS720. The fumed silica is added to the ethylene glycol/propylene glycol while stirring in a Ross 100LC mixer at around 1500 rpm. The speed is increased to 2000 rpm and the suspension is mixed for three minutes. The carbonyl iron particles are then added while mixing at 2500 rpm. Finally, the fluid is mixed at 2500 rpm for five minutes. The TS720 thickener was effective for all of the glycol ratios tested regardless of whether a foam or gel was formed. It was further found that the glycol-based MR fluids generally require between about 3% and about 6% weight fraction of the TS720 fumed silica to effectively thicken and limit the settling of the carbonyl iron powder.

Example 3

This example compares various commercially available clay products to investigate the impact of the type of clay, the type of surface treatment, and/or the level of surface treatment on the ability to thicken propylene glycol. Various grades of CLOISITE® (10A, 15A, 20A, 25A, 30B and 93A) and GARAMITE® 1958, all available from Southern Clay Products, were tested as follows: 177 grams of iron powder (Hoeganaes FPI) was mixed with 79 grams propylene glycol and 5.5 grams organoclay. This mixture corresponds to 7% organoclay by weight of the propylene glycol. The mixture was homogenized by mixing in a mixer using an anchor paddle rotating at 500 rpm for about 10 minutes. The resulting fluid was then subjected to high shear in a rotor-stator homogenizer with a 25 mm blade running at 19,000 rpm for 3 minutes. The sample fluids were poured into glass jars and set on a benchtop for two weeks. At the end of two weeks, the percent settling was measured as follows. The total height of the liquid was measured using a measuring ruler accurate to 0.5 mm. The height of the clear layer of liquid atop the settled layer was measured using the same ruler. The latter measurement was divided by the former measurement, and the ratio was multiplied by 100 to obtain the percent settling of each sample. The results are provided in Table 1.

TABLE 1

| Thickener | Description | Percent Settling |
|---|---|---|
| CLOISITE ® 10A | Organoclay | 28% |
| CLOISITE ® 15A | Organoclay | 25% |
| CLOISITE ® 20A | Organoclay | 29% |
| CLOISITE ® 25A | Organoclay | 34% |

TABLE 1-continued

| Thickener | Description | Percent Settling |
|---|---|---|
| CLOISITE ® 30B | Organoclay | 32% |
| CLOISITE ® 93A | Organoclay | 23% |
| GARAMITE ® 1958 | Organoclay | 7% |

As discussed above, most automotive applications cannot tolerate settling of the magnetic particles in an amount greater than 20%, and in some critical applications, a value less than about 10% is required. Thus, the CLOISITE® organoclays all exhibited percent settling above 20%. Only the GARAMITE® 1958 organoclay exhibited percent settling meeting the requirements for most automotive applications, as well as certain critical applications. The CLOISITE® organoclays are surface-treated montmorillonite clays, whereas the GARAMITE® 1958 is a mineral clay mixture, as described above, containing sepiolite and/or palygorskite. Thus, this example supports the position that the combination of sepiolite and/or palygorskite with a smectite clay exhibits an unexpected improvement in thickening propylene glycol fluids, whereas smectite clays, mainly montmorillonite clays, are not sufficiently effective in thickening propylene glycol, regardless of variations in the type and level of surface treatment.

Example 4

This example demonstrates the difference in thickening affect for various treated fumed silicas and untreated fumed silicas. Testing included CABOSIL® treated grades (TS530, TS610 and TS720) and untreated grades (EH5, M5), available from Cabot Corporation, and AEROSIL® treated grades (R202, R974 and R972), and untreated grades (200 and 380), available from Degussa AG. For the fumed silicas, 177 grams of iron powder (Hoeganaes FPI) was mixed with 81 grams propylene glycol and 3 grams fumed silica. This mixture corresponds to 3.5% fumed silica by weight of propylene glycol. The mixture was homogenized in a mixer using an anchor paddle rotating at 500 rpm for about 10 minutes. The fluid was then subjected to high shear in a rotor-stator homogenizer with a 25 mm blade running at 19,000 rpm for 3 minutes. The resulting fluids were poured into glass jars and set on a benchtop for two weeks. At the end of two weeks, the percent settling was measured in the same manner as in Example 3. The results of the settling tests are provided in Table 2.

TABLE 2

| Thickener | Description | Carbon Content (%) | Specific Surface Area ($m^2/g$) | Percent Settling |
|---|---|---|---|---|
| CABOSIL ® M5 | Untreated Fumed Silica | 0 | 200 | 52% |
| AEROSIL ® 200 | Untreated Fumed Silica | 0 | 200 | 55% |
| CABOSIL ® EH5 | Untreated Fumed Silica | 0 | 380 | 51% |
| AEROSIL ® 380 | Untreated Fumed Silica | 0 | 380 | 53.75% |
| CABOSIL ® TS610 | Treated Fumed Silica | 0.7–1.0 | 105–145 | 51% |
| AEROSIL ® R972 | Treated Fumed Silica | 0.6–1.2 | 90–130 | 52.5% |
| AEROSIL ® R974 | Treated Fumed Silica | 0.7–1.3 | 150–190 | 52.5% |
| CABOSIL ® TS610 | Treated Fumed Silica | 0.7–1.0 | 105–145 | 51% |
| CABOSIL ® TS530 | Treated Fumed Silica | 3.75–4.75 | 205–245 | 28% |
| CABOSIL ® TS720 | Treated Fumed Silica | 4.8–6.0 | 105–130 | 12% |
| AEROSIL ® R202 | Treated Fumed Silica | 3.5–5.0 | 80–120 | 12% |

Untreated fumed silicas thicken fluids by interparticle hydrogen bonding. However, in the presence of a solvent such as propylene glycol, the hydrogen bonding sites on the particle surfaces are blocked by the strongly polar hydroxyl groups of the glycol. As indicated by the settling tests, poor thickening is achieved with the untreated fumed silicas, as indicated by the large percent settling. Treated fumed silicas, on the other hand, thicken fluids by chain entanglement of large molecules on the surface of the particles. As indicated by the settling tests, however, CABOSIL® TS610, AEROSIL® R972 and AEROSIL® R974 exhibit poor thickening, as indicated by large percent settling, due to the surface treatment being only a partial treatment (less than 2% carbon), and the surface molecule being relatively small. Dimethyldichlorosilane was used for the partial surface treatment, which has a molecular weight of only 74. The CABOSIL®TS530 is fully treated, but uses a small treatment molecule compared to that used for the CABOSIL® TS720 and AEROSIL® R202. Specifically, the CABOSIL® TS530 includes surface treatment with hexamethyldisilazane, which has a molecular weight of only 89. The CABOSIL® TS720 and AEROSIL® R202 have full surface treatment with a very large molecule, and exhibit an unexpectedly effective thickening of the propylene glycol. Specifically, both CABOSIL® TS720 and AEROSIL® R202 have surface treatment with polydimethylsiloxane, which has a molecular weight, depending on the number of dimethylsiloxane units, of at least about 200, and advantageously at least about 600. It may also be observed that the specific surface area (B.E.T.) of the silica (i.e., particle size) does not appear to have any effect on the ability of the silica to thicken the fluid.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A magnetorheological fluid formulation comprising:

a non-aqueous liquid vehicle substantially free of water and comprising a glycol-based fluid;

magnetizable particles dispersed in the liquid vehicle; and a thickener selected from the group consisting of:

(a) surface treated fumed silica fully treated with a treatment molecule having a molecular weight of at least about 200, and (b) surface treated clay comprising at least one of sepiolite or palygorskite, or a mixture thereof.

2. The formulation of claim 1 wherein the liquid vehicle consists essentially of propylene glycol and optionally ethylene glycol.

3. The formulation of claim 2 wherein the ratio of ethylene glycol to propylene glycol is about 70:30 to about 0:100.

4. The formulation of claim 1 wherein the glycol-based fluid comprises at least about 50 wt. % propylene glycol, balance ethylene glycol.

5. The formulation of claim 1 comprising thickener (a), wherein the surface treated fumed silica is fully treated with polydimethylsiloxane.

6. The formulation of claim 5 wherein the polydimethylsiloxane has a molecular weight greater than about 600.

7. The formulation of claim 1 comprising thickener (a), wherein the treatment molecule has a molecular weight of at least about 600.

8. The formulation of claim 1 comprising thickener (a) in an amount of about 3–6 wt. %.

9. The formulation of claim 1 comprising thickener (b), wherein the surface treated clay comprises a clay mixture of about 50–95 wt. % sepiolite, palygorskite, or a combination of sepiolite and palygorskite, the balance smectite.

10. The formulation of claim 9 wherein the clay mixture is surface treated with an alkyl quaternary ammonium salt.

11. The formulation of claim 1 comprising thickener (b) in an amount of about 7–10 wt. %.

12. The formulation of claim 1 further comprising additives selected from the group consisting of corrosion inhibitors, deaerators, defoamers, preservatives, dyes and pigments.

13. A magnetorheological fluid formulation comprising:

a non-aqueous liquid vehicle consisting essentially of ethylene glycol and propylene glycol in a ratio of about 70:30 to about 0:100;

magnetizable particles dispersed in the liquid vehicle; and a thickener selected from the group consisting of:

(a) surface treated fumed silica fully treated with a treatment molecule having a molecular weight of at least about 600, and (b) surface treated clay comprising a mixture of about 50–95 wt. % sepiolite, palygorskite, or a combination of sepiolite and palygorskite, the balance smectite.

14. The formulation of claim 13 wherein the non-aqueous liquid vehicle consists essentially of at least about 50 wt. % propylene glycol, balance ethylene glycol.

15. The formulation of claim 13 comprising thickener (a), wherein the surface treated fumed silica is fully treated with polydimethylsiloxane.

16. The formulation of claim 13 comprising thickener (a) in an amount of about 3–6 wt. %.

17. The formulation of claim 13 comprising thickener (b), wherein the clay mixture is surface treated with an alkyl quaternary ammonium salt.

18. The formulation of claim 13 comprising thickener (b) in an amount of about 7–10 wt. %.

19. The formulation of claim 13 further comprising additives selected from the group consisting of corrosion inhibitors, deaerators, defoamers, preservatives, dyes and pigments.

20. A magnetorheological fluid formulation comprising:

a non-aqueous liquid vehicle substantially free of water and comprising a glycol-based fluid;

magnetizable particles dispersed in the liquid vehicle; and surface treated clay comprising at least one of sepiolite or palygorskite, or a combination thereat.

21. The formulation of claim 20 wherein the liquid vehicle consists essentially of propylene glycol and optionally ethylene glycol.

22. The formulation of claim 21 wherein the ratio of ethylene glycol to propylene glycol is about 70:30 to about 0:100.

23. The formulation of claim 20 wherein the glycol-based fluid comprises at least about 50 wt. % propylene glycol, balance ethylene glycol.

24. The formulation of claim 20 wherein the surface treated clay comprises a clay mixture of about 50–95 wt. % sepiolite, palygorskite, or a combination of sepiolite and palygorskite, the balance smectite.

25. The formulation of claim 24 wherein the clay mixture is surface treated with an alkyl quaternary ammonium salt.

26. The formulation of claim 20 comprising the surface treated clay in an amount of about 7–10 wt. %.

* * * * *